United States Patent [19]

Legille

[11] 4,157,816

[45] Jun. 12, 1979

[54] SHAFT FURNACE COOLING

[75] Inventor: Edouard Legille, Luxembourg, Luxembourg

[73] Assignee: S.A. des Anciens Etablissements Paul Wurth, Luxembourg, Luxembourg

[21] Appl. No.: 857,752

[22] Filed: Dec. 5, 1977

[30] Foreign Application Priority Data

Dec. 8, 1976 [LU] Luxembourg ..... 76349

[51] Int. Cl.[2] ..... C21B 7/10

[52] U.S. Cl. ..... 266/194

[58] Field of Search ..... 266/190, 192–194; 222/6 B

[56] References Cited

U.S. PATENT DOCUMENTS

| | | | |
|---|---|---|---|
| 678,743 | 7/1901 | Kennedy | 266/194 |
| 843,950 | 2/1907 | Kennedy | 266/194 |
| 853,698 | 5/1907 | Hunter | 266/190 |
| 1,749,395 | 3/1930 | Rice | 122/6 B |
| 2,256,179 | 9/1941 | Thomson | 122/6 B |
| 3,325,159 | 6/1967 | Loecher | 266/193 |
| 3,379,427 | 4/1968 | Zherebin et al. | 266/190 |
| 3,679,194 | 7/1972 | Jones et al. | 266/193 |

FOREIGN PATENT DOCUMENTS

| | | | |
|---|---|---|---|
| 1239433 | 7/1960 | France | 266/193 |
| 47-40162 | 11/1972 | Japan | 266/194 |

*Primary Examiner*—Gerald A. Dost

[57] ABSTRACT

Cooling of the wall of a shaft furnace is achieved through the use of a plurality of individual cooling elements, through which a coolant may be circulated, which cooperate to form a lining immediately inwardly of the furnace metal shell. The cooling elements are supported on the shell, rather than being secured thereto, and may be replaced by removal through openings in the shell which are normally hermetically sealed by covers.

8 Claims, 1 Drawing Figure

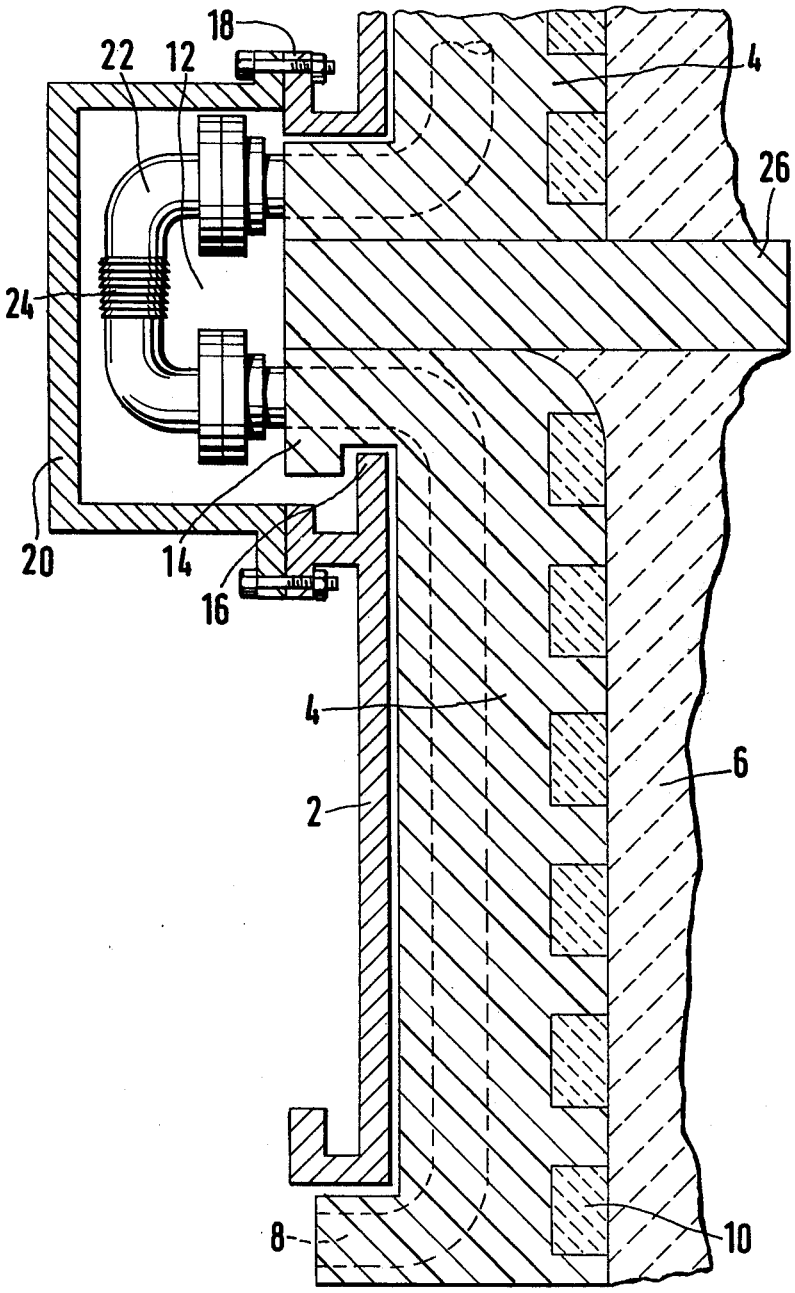
18
22
12
4
26
24
20
14
16
4
6
2
8
10

SHAFT FURNACE COOLING

BACKGROUND OF THE INVENTION (1) Field of the Invention

The present invention relates to cooling the walls of shaft furnaces. More specifically, this invention is directed to apparatus for use in the circulation of a coolant between the external steel shell and the internal refractory lining of a blast furnace. Accordingly, the general objects of the present invention are to provide novel and improved methods and apparatus of such character.

(2) Description of the Prior Art

A shaft furnace, for example a high-capacity blast furnace of the type used in the steel industry, will typically have a wall defined by an outer metal jacket and an inner lining of refractory brickwork. Since the refractory brickwork will deteriorate with time, it is desirable to provide means for at least partly protecting the inner surface of the metal jacket. This protection means will take the form of a cooling system whereby a coolant may be circulated through at least portions of the region between the inner surface of the external metal jacket and the refractory brickwork. Two types of cooling systems are known in the prior art. These known art cooling systems are generally referred to as being of either the "cooling box" type or the "stave cooler" type. In either case, the cooling system is comprised of a plurality of individual cooling elements which function to both prevent overheating of the inner surface of the metal blast furnace external jacket and to cool, and thus extend the life of, the refractory lining.

In the "cooling box" type of system, a large number of spaced and inwardly extending "boxes", which may be formed of copper, are installed in the furnace wall. In the case of a high-capacity blast furnace, it has been known to employ up to 1700 cooling boxes. The "cooling boxes" are each equipped with a single multiple internal circuit for the circulation of a coolant, which is typically water, and the "cooling boxes" are customarily arranged in series and inter-connected outside of the furnace jacket. Tests have shown that the degree of cooling of the refractory brickwork achieved with a set of cooling boxes may be plotted as curves, which resemble cycloids, with the "hot spots" being close to the jacket and between individual boxes and with the amount of cooling achieved varying over the furnace wall in the vertical direction.

The "stave coolers", which are also know as "cooling plates", consist of rectanglar cast iron panels which are traversed internally, and parallel to their main faces, by a number of conduits. The conduits may be oriented parallel to one another and to the axis of the furnace or arranged in coils. The "stave coolers" vary in thickness from approximately 16 cm to 25 cm when new and are bolted to the inner surface of the jacket and therefore form a complete lining for the jacket. The inner surfaces of the stave coolers, i.e., the surfaces facing towards the interior of the furnace, may be provided with a lining of refractory brick. The space between adjacent cooling plates and any gap which may be left between the furnace jacket and the refractory lining will be respectively filled with a mortar and with a refractory paste. The conduits provided in the "stave coolers" are interconnected vertically in series with the connection between the conduits of adjacent vertically spaced plates being made outside of the furnace jacket.

The operational life of a shaft furnace, i.e., the time between major overhauls, is a function of the durability of the inner refractory brickwork and this is a function of the efficiency of the furnace cooling system. The refractory brickwork, as is well known, undergoes considerable wear as a function of mechanical and thermal stresses and also as a result of chemical reactions. The prior art cooling systems have possessed certain deficiencies which have limited their ability to provide cooling to the refractory brickwork, thus enhancing its service life, and to simultaneously provide protection for the furnace jacket.

In the prior art box-type cooling systems the wear and erosion of the refractory brickwork is approximately in accordance with the aforementioned cycloidal or isothermal curves. The "noses" of the individual cooling boxes become increasingly subject to wear as the brickwork suffers wear. The cooling boxes therefore undergo increasing strain which may lead to their destruction. On the other hand, a cooling box system has the attribute of ease of repair since worn boxes may be replaced with comparative ease. Nevertheless, because of the geometrical arrangement of the cooling boxes and the reduction in thickness of the brickwork which occurs with time, the external furnace jacket suffers increasing stresses as a result of temperature differentials and the risk of deformation or premature destruction of the jacket is aggravated. Cooling box type systems involve the further drawback of being unsuitable for use in evaporative type cooling which is finding ever increasing favor since the steam generated during evaporative cooling can be employed for power generation and because evaporative cooling requires less coolant. The inability to use cooling boxes in evaporative cooling results from the fact that the horizontal arrangement of the cooling boxes and variations in the cross section of the circulation channels cause interference with the circulation of the coolant.

"Stave coolers" have the attribute, when compared with cooling boxes, of producing more uniform cooling thereby minimizing the occurrence of "hot spots" resulting from the more localized cooling at separate points as effected in a cooling box system. Also, "stave coolers" may be utilized in a cooling system based upon evaporative cooling. On the other hand, prior art "stave coolers" cannot be dismantled or replaced. In this regard it is to be noted that the refractory brickwork initially provided on the internal surface of the "stave coolers" rapidly disappears in the course of operation of the blast furnace. When this brickwork has disappeared, deposits or "coatings" may form on the internal surface of the plates, and these coatings are periodically eroded and reformed. When the original refractory brickwork has been eroded, the cooling plates have to depend on these coatings for protection against wear. The coatings do not provide a sufficiently durable and effective means of protection partly because they tend to collapse for want of any type of support. In blast furnace operation it has previously been common practice to render inoperative, by means of short circuiting, individual stave coolers which have worn to the point where their internal coolant conduits have been breached. When an excessive number of cooling plates have been removed from the coolant circulation system by such "short-circuiting", it becomes necessary to shut down the furnace for major overhaul.

SUMMARY OF THE INVENTION

The present invention overcomes the above-briefly described and other deficiencies and disadvantages of the prior art by providing a novel and improved technique for achieving cooling of the walls of shaft furnaces and by providing apparatus for use in the practice of this novel technique. In accordance with the present invention, a cooling installation is provided wherein individual cooling elements can be easily dismantled and replaced, wherein uniform cooling of the wall of a shaft furnace is insured and wherein cooling may be achieved either by conventional circulation of a coolant or by evaporative cooling.

Apparatus in accordance with the present invention contemplates use of a plurality of individual cooling elements which are detachably secured to the jacket of a shaft furnace; the jacket being provided with spacially displaced openings dimensioned to permit passage of the cooling elements therethrough. In accordance with a preferred embodiment, the individual cooling elements of the present invention are arranged in vertical columns with adjacent elements in each column being separated, on a level in registration with the openings in the furnace jacket, by a spacer block.

Apparatus in accordance with the present invention also contemplates cooling elements which function at least as a partial lining for the internal face of the furnace jacket. The cooling elements of the present invention comprise panels through which coolant circulation conduits pass and means for detachably securing these panels to the furnace jacket. In accordance with a preferred embodiment, at least the upper end of each panel is provided with an outwardly extending projection which defines a U-shaped groove whereby the panels may be "hung" on the furnace jacket when the projection extends through one of the openings therein.

BRIEF DESCRIPTION OF THE DRAWING

The present invention will be better understood and its numerous objects and advantages will become apparent to those skilled in the art by reference to the accompanying drawing which comprises a schematic illustration of a vertical section taken through a portion of the wall of a blast furnace which is cooled in accordance with the present invention.

DESCRIPTION OF THE PREFERRED EMBODIMENT

With reference now to the drawing, a shaft furnace is provided with an external metal shell or jacket 2. The inner face of jacket 2 is lined with cooling elements 4 which are fabricated in accordance with the present invention as will be described in greater detail below. The cooling elements 4 are, in turn, initially covered with refractory brickwork and, in time, will be covered by a "coating" 6. The cooling elements 4 in accordance with the disclosed embodiment of the present invention are comprised of panels of cast iron through which a plurality of conduits, such as conduit 8, pass in the vertical direction. There will typically be four parallel conduits 8 in each cooling element. Alternatively, the conduits 8 through which the coolant will be circulated may be in the form of coils. The cooling elements 4 are each provided, on the inwardly disposed face, with a lining of refractory bricks 10. The refractory bricks 10 reduce the thermal stresses acting on the cooling elements and enable the coating, which forms on the surface of the cooling elements after erosion of the original refractory brickwork lining, to adhere more firmly to the cooling elements. Restated, when the furnace is originally placed in operation, the cooling elements will be isolated from the interior of the furnace by means of a refractory brickwork and, after a period of operation, the refractory brickwork will be replaced by a coating; reference numeral 6 indicating either the brickwork or the coating.

A significant feature of the present invention resides in the fact that the cooling elements 4 are removable and replaceable without requiring a complete rebuilding of the furnace wall. Thus, in accordance with the present invention the furnace jacket 2 is provided with openings 12 which are sufficiently large to enable the cooling elements 4 to be passed therethrough. Also in accordance with the present invention, the cooling elements 4 are merely "hung" on the lower edges 16 of the openings 12 as shown rather than being bolted or welded to the jacket. The supporting of the cooling elements 4 on the furnace jacket is accomplished by providing the cooling elements with externally extending projections 14 which are each provided, on their downwardly facing side, with U-shaped grooves which engage the upper edges of the openings 12 in the jacket 2.

The furnace jacket is provided, about each aperture 12, with a flange 18. Accordingly, the openings 12 in the furnace jacket may be hermetically closed by means of covers 20 which are bolted to flange 18. The covers 20 also define a chamber wherein connection may be made between the coolant circulation conduits of serially connected cooling elements. As shown in the drawing, the interconnection may include a pair of "elbows" 22 which are interconnected by means of a flexible compensator 24 which functions to balance out thermal expansions and manufacturing inaccuracies. As an alternative arrangement, the connection between the conduits of adjacent, vertically displaced cooling elements may be made outside of cover 20.

The cooling elements 4 are separated by means of "blocks" 26 which preferably extend inwardly beyond the inner face of the cooling elements and thus function to support the refractory brickwork or coating 6. The "blocks" 26 may consist of "cooling boxes", of the type known in the prior art, and will be traversed by conduits, not shown, through which a coolant is circulated. The conduits which are employed to circulate coolant through the "blocks" 26 can be connected to an auxiliary source of pressurized coolant or may be connected into the cooling circuit for the elements 4.

When the internal refractory brickwork has disappeared and the erosion and wear suffered by the cooling elements leads to the destruction of one or more of the conduits 8, the damaged cooling element or elements 4 may be replaced with comparative ease during a period in which the operation of the blast furnace is terminated, or slowed down, in accordance with a planned operational schedule. All that is required to replace a damaged cooling element 4 is to remove the covers 20 from the openings 12, which are in partial registration therewith, disconnect the fluid coupling to the pair of adjacent cooling elements, remove the "block" 26 through the opening 12 at the end of the cooling element to be replaced which is engaged with the lip of a jacket opening and thereafter remove the cooling element itself via the opening 12. Before the "block" 26 and the cooling element 4 can be released, it is usually necessary to vibrate these components since they will typically be stuck to one another and to adjacent parts of the furnace as a result of the formation of a "coating" 6 and also because of the introduction of a mortar into the interstices between the various components during assembly of the furnace. The release of the cooling element requires lifting and handling equipment which will enable the cooling element to be tilted into a horizontal position during removal through opening 12. The installation of a new cooling element, of course, requires the same operations in the reverse order. Prior to the introduction of the replacement cooling element through opening 12 it is possible to introduce a working platform through the opening so that maintenance personnel can enter the furnace in order to conduct inspection and to carry out any necessary maintenance work such as, for example, cleaning the internal surface of the jacket 2.

When a cooling element has to be replaced, it has been found that it may be advantageous, as a result of the fact that the original internal refractory brickwork has entirely disappeared, to coat the internal surface of the replacement cooling element with a refractory coating which supplements the brickwork 10.

In the embodiment of the invention depicted in the drawing there are as many openings 12 in the furnace jacket 2 as there are cooling elements. If the cooling elements are to be associated with one another in vertical columns, horizontal rows about the periphery of the furnace should preferably be avoided. This will result in the columns of cooling elements being staggered about the periphery of the furnace such that the openings 12 of one vertical column are offset vertically in relation to the openings 12 of the two adjacent columns. It is also possible to arrange the system of the present invention in such a manner that two adjacent cooling elements can be released through the same opening 12 whereby the number of openings in the furnace jacket are minimized. By way of example, the lower of a pair of cooling elements can be arranged as shown in the drawing and the upper element 4 may be reversed by 180° whereby it rests on the block 26, rather than being hung over and thus supported by a lip of an opening in jacket 2, and the edge of the upper cooling element with the projection 14 therein would be engaged with the upper edge of opening 12.

The cooling elements 4 in accordance with the present invention are removed and inserted through the openings 12 in the jacket 2 by pivoting them about an imaginary horizontal axis. Without departing from the scope of the invention it would be possible to position the openings vertically between the longitudinal sides of two elements of one end of the same horizontal row in order to be able to release the cooling elements by pivoting them about a vertical axis. The design of the removable cooling elements of the present invention imposes no limitative effect on the type of cooling process employed and thus either liquid cooling or evaporative cooling can be employed with either natural or forced circulation.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a shaft furnace, the furnace wall being defined by an external metal jacket and initially a refractory lining, an improved cooling system for the furnace wall comprising:

a plurality of cooling elements positioned adjacent the inner surface of the jacket and having the shape of flat vertically oriented panels forming a lining on the inner surface of the jacket, said panels having top and bottom ends, said cooling elements including means by which a coolant may be circulated therethrough;

a plurality of openings in the furnace jacket, said openings being dimensioned to permit passage of said cooling elements therethrough;

spacer means positioned between and in contact with the top and bottom ends respectively of adjacent cooling elements to space said cooling elements in the vertical direction, said spacer means being located in registration with said jacket openings whereby said spacer means may be removed through said openings to provide a clearance between vertically adjacent cooling elements to permit removal of said cooling elements through said jacket openings; and means for removably supporting said cooling elements on said jacket.

2. The apparatus of claim 1 further comprising:

a flange extending about each of the openings in said jacket at the exterior of the furnace wall, said flange being integral with the jacket; and cover means, said cover means cooperating with said flanges to hermetically seal said openings, said cover means being removably attached to said flanges.

3. The apparatus of claim 1 wherein said cooling elements are arranged in vertical columns and wherein said spacer means comprises:

cooling means disposed between adjacent cooling elements in said columns.

4. The apparatus of claim 2 wherein said cooling elements are arranged in vertical columns and wherein said spacer means comprises:

cooling means disposed between adjacent cooling elements in said columns.

5. The apparatus of claim 1 further comprising:

means for fluidically coupling adjacent cooling elements, said fluidic coupling means including flexible means for compensating for thermally induced expansion.

6. The apparatus of claim 4 further comprising:

means for fluidically coupling adjacent cooling elements in series, said fluidic coupling means including flexible means for compensating for thermally induced expansion, said coupling means being disposed within the openings defined by said cover means.

7. The apparatus of claim 1 wherein said means for removably supporting said cooling elements on said furnace jacket comprises:

a projection on each of said cooling elements, said projections extending through said openings and engaging the jacket at the lip of said openings.

8. The apparatus of claim 6 wherein said means for removably supporting said cooling elements on said furnace jacket comprises:

a projection on each of said cooling elements, said projections extending through said openings and engaging the jacket at the lip of said openings.

* * * * *